US007712743B1

(12) United States Patent
Miller

(10) Patent No.: US 7,712,743 B1
(45) Date of Patent: May 11, 2010

(54) THREE-DIMENSIONAL REACTIONARY TURKEY TARGET

(76) Inventor: Thomas John Miller, 875 Grace Dr., Carmel, IN (US) 46032

( * ) Notice: Subject to any disclaimer, the term of this patent is extended or adjusted under 35 U.S.C. 154(b) by 0 days.

(21) Appl. No.: 12/072,581

(22) Filed: Feb. 27, 2008

(51) Int. Cl.
*F41J 5/26* (2006.01)
*F41J 1/10* (2006.01)

(52) U.S. Cl. ..... 273/407; 273/403; 273/380

(58) Field of Classification Search ..... 273/380, 273/403–410, 362–365
See application file for complete search history.

(56) References Cited

U.S. PATENT DOCUMENTS

| | | | | | |
|---|---|---|---|---|---|
| 1,970,676 | A | * | 8/1934 | Van Auken | 273/380 |
| 2,076,135 | A | * | 4/1937 | Stowell | 273/380 |
| 2,812,947 | A | * | 11/1957 | Fatzinger et al. | 273/404 |
| 3,413,003 | A | * | 11/1968 | Bell | 273/408 |
| 4,124,550 | A | | 11/1978 | Kobayashi et al. | |
| 4,477,082 | A | * | 10/1984 | McKenzie et al. | 273/403 |
| 4,568,087 | A | | 2/1986 | Schreiner-Hansen | |
| 4,623,150 | A | | 11/1986 | Moehlman et al. | |
| 4,801,150 | A | | 1/1989 | Stevenson | |
| 4,805,918 | A | | 2/1989 | Feinberg | |
| 4,921,250 | A | * | 5/1990 | Ayres | 273/380 |
| 4,976,038 | A | | 12/1990 | Nattrass | |
| 5,174,581 | A | | 12/1992 | Goodson | |
| 5,275,890 | A | | 1/1994 | Wolf | |
| 5,316,313 | A | | 5/1994 | Moore | |
| 5,415,415 | A | | 5/1995 | Mujic | |
| 5,501,467 | A | | 3/1996 | Kandel | |
| 5,503,403 | A | | 4/1996 | Morrell | |
| 5,632,491 | A | * | 5/1997 | Hamas | 273/407 |
| 5,649,707 | A | | 7/1997 | Brander et al. | |
| 5,735,526 | A | | 4/1998 | Mastandrea | |
| 6,213,470 | B1 | | 4/2001 | Miller | |
| 6,254,100 | B1 | | 7/2001 | Rinehart | |
| 6,575,469 | B2 | | 6/2003 | Love | |
| 6,715,759 | B2 | | 4/2004 | Gladders et al. | |
| 7,134,977 | B2 | * | 11/2006 | Campbell et al. | 473/454 |
| 7,422,217 | B2 | * | 9/2008 | Hinnant | 273/407 |
| 2005/0006848 | A1 | * | 1/2005 | Fort, II | 273/407 |
| 2007/0262529 | A1 | * | 11/2007 | Gamez et al. | 273/409 |

* cited by examiner

*Primary Examiner*—Mark S Graham
(74) *Attorney, Agent, or Firm*—Fraser Clemens; Martin & Miller LLC; J. Douglas Miller

(57) ABSTRACT

A three-dimensional reactionary turkey target includes a target stand shaped to represent the body of a turkey and a reactionary head and neck target that is shaped to represent the vital region of a turkey's head and neck. The head and neck target connects to the target stand, which is held in position via a support means. The target allows youth, novice, and experienced turkey hunters to assess the pattern of a turkey gun, gauge the shooter's accuracy, determine the efficacy of ammunition, and practice with a life-like target.

19 Claims, 5 Drawing Sheets

THREE-DIMENSIONAL REACTIONARY TURKEY TARGET

CROSS-REFERENCE TO RELATED APPLICATIONS

Not Applicable

FEDERALLY SPONSORED RESEARCH

Not Applicable

SEQUENCE LISTING OR PROGRAM

Not Applicable

BACKGROUND OF THE INVENTION

1. Field of Invention

This invention relates to turkey targets, specifically to such targets used for shooting practice, patterning a shotgun, or determining accuracy with a shotgun.

2. Prior Art

The present invention is directed to the field of targets. More particularly, this invention concerns a three-dimensional shotgun target having a turkey-shaped body that functions as a target stand, and a replaceable, frangible head and neck target that simulates a turkey's vital region. The shotgun target provides a practice experience more closely related to actual shotgun hunting of wild turkeys. Regardless of the shooter's firing position relative to the target, an indication of the accuracy, penetration, and likely damage of the shot is readily observable.

Turkey hunters commonly pattern their shotguns prior to hunting season. They do this on paper. This allows them to see how the shot pattern disperses when the gun and game load are fired from several distances.

Originally patterning was accomplished with nothing more than blank paper, traditional "bulls-eye" targets or advancements on these simple concepts to clearly indicate point of impact, for example in U.S. Pat. No. 6,213,470 to Miller (2001), U.S. Pat. No. 5,275,890 to Wolf, et al (1994), U.S. Pat. No. 5,415,415 to Mujic (1995), and U.S. Pat. No. 5,501,467 to Kandel (1996). However, without a likeness of the game animal on the paper, it was impossible to "practice like you hunt." U.S. Pat. No. 5,735,526 to Mastandrea (1998) put the images of game animals on paper, making this a standard patterning tool for the modern shotgun hunter.

Paper targets imprinted with a turkey head are a popular patterning tool. Though they indicate the shotgun's pattern and accuracy, and are inexpensive to manufacture, nevertheless they must be replaced after every shot and, without a three-dimensional body, they do not present a life-like target for shooting practice. These targets, being composed of paper and thus lacking a reactionary element, also offer little gratification from a well-placed shot.

Archery hunters pioneered the use of three-dimensional game targets. These targets are life-sized, realistic reproductions of typical game animals, including deer, turkey, and bear. They typically have a shell body and a vital organ cavity placed therein. The vital organ cavity generally consists of foam or layered foam. Some have realistic indicia of the animal's vital organs. Examples of such archery targets are found in U.S. Pat. No. 5,503,403 to Morrell (1996), U.S. Pat. No. 6,254,100 to Reinhart (2001), and U.S. Pat. No. 6,575,469 to Love (2003).

While conventional three-dimensional targets are useful to archery hunters, turkey hunters who pursue their game with a shotgun gain no benefit. This is because archery hunters aim for the body of a turkey. Shotgun hunters aim for a turkey's head and neck, preferably when this vital area is extended away from the body.

Trap and skeet shooters are familiar with the pleasure that comes from accurate shooting. They fire at moving targets, traditionally called clay pigeons. These targets are manually thrown or launched from special machines. The clay pigeons fly across the shooter's field of fire. An accurate shot causes the clay pigeon to break or shatter in mid-flight.

Inventors have created several types of clay pigeons, for example in U.S. Pat. No. 4,623,150 to Moehlman, et al (1986), U.S. Pat. No. 6,715,759 to Gladders, et al (2004), U.S. Pat. No. 4,124,550 to Kobayashi, et al (1976), U.S. Pat. No. 4,801,150 to Stevenson (1989), U.S. Pat. No. 4,568,087 to Schreiner-Hansen (1986), U.S. Pat. No. 5,174,581 to Goodson (1992) and U.S. Pat. No. 5,649,707 to Brander, et al (1997). While these clay pigeons are frangible targets, nevertheless all the clay pigeons heretofore known suffer from a number a disadvantages for turkey hunters:

a) Their manufacture is saucer-shaped, which does not accurately represent the typical head and neck target for the turkey hunter.

b) Their saucer shape represents a traditional target for wing shooting, which is the art or practice of shooting at game birds in flight or at flying targets. Turkeys are typically shot on the ground and in a stationary or near-stationary position.

c) Clay pigeons are often painted fluorescent orange or other similar bright colors. This makes them more noticeable while in flight. These bright colors are not accurate representations of real turkeys.

OBJECTS AND ADVANTAGES

Accordingly, several objects and advantages of the present invention are:

a) to provide a reactionary turkey target shaped like the head and neck of a turkey.

b) to provide a reactionary head and neck turkey target whose measurements and dimensions accurately represent a turkey;

d) to provide a head and neck target that, upon being shot at various distances, will break into multiple pieces; and e) to provide a head and neck target designed to be attached to a stand, which will be a representation of a turkey body.

Further objects and advantages are to provide a three-dimensional reactionary head and neck target that is accurate in size, shape, and detail to turkeys, which is simple and inexpensive to manufacture, which can be easily attached and removed from the stand, and which, upon being shot, provides immediate verification of the accuracy and patterning of a shotgun.

SUMMARY

In accordance with the present invention a reactionary turkey target comprises a three-dimensional figure having the distinct appearance of the head and neck of a turkey. The target shall easily attach to and detach from the stand, which shall simulate the shape and appearance of a turkey.

DRAWINGS

Figures

DRAWINGS

Reference Numerals

Figure 1:
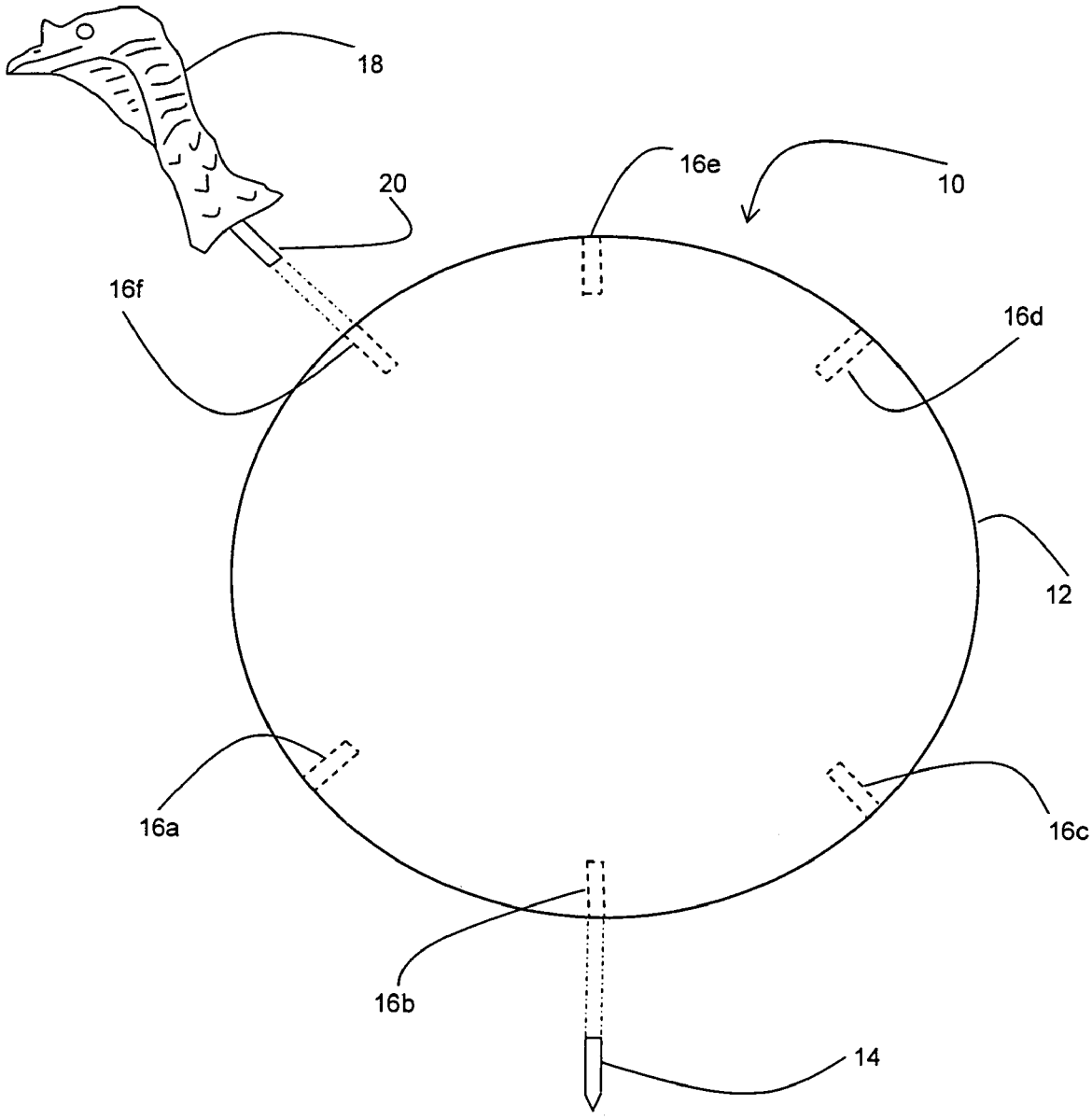
FIG. 1 is a perspective view of a three-dimensional shotgun target simulating a turkey according to the present invention.
Figure 2:
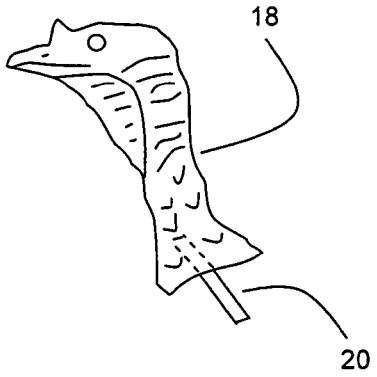
FIG. 2 is a perspective view of the head and neck target of FIG. 1 as viewed from one side of the target.
Figure 3:
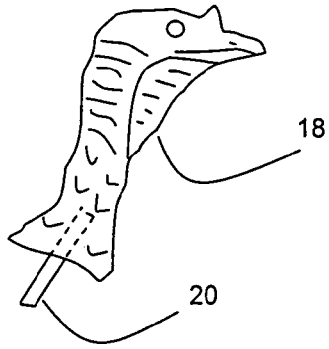
FIG. 3 is a perspective view of the head and neck target of FIG. 1 as viewed from the opposite perspective of FIG. 2.
Figure 4:
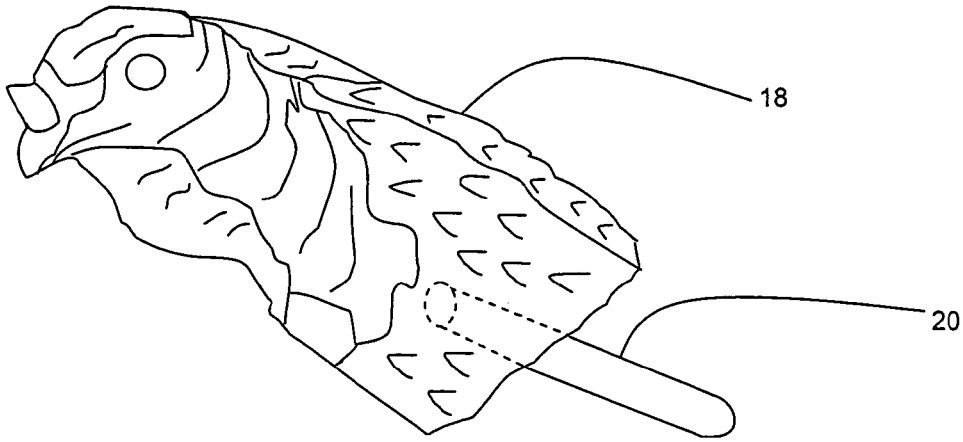
FIG. 4 is a perspective view of the head and neck target with a connection dowel built into the head and neck target. This dowel attaches the target to the stand, as shown in FIG. 1.
Figure 5:
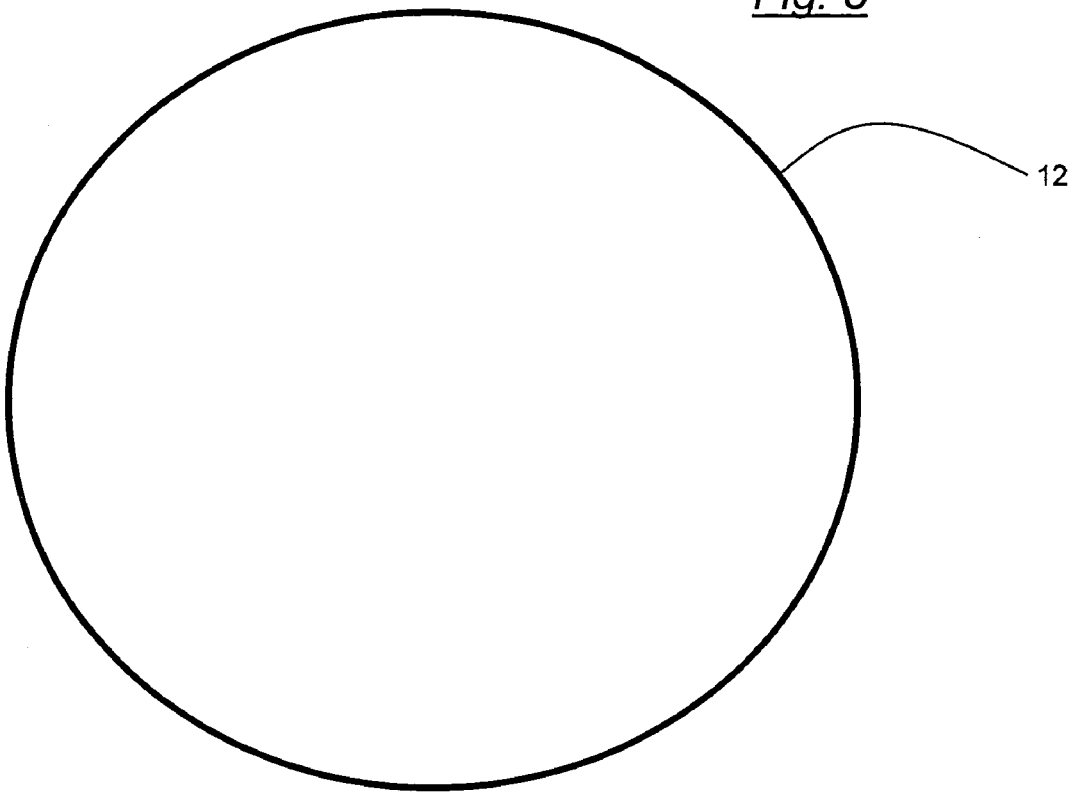
FIGS. 5 and 6 are perspective views of the stand, as seen from the side and above.
Figure 6:
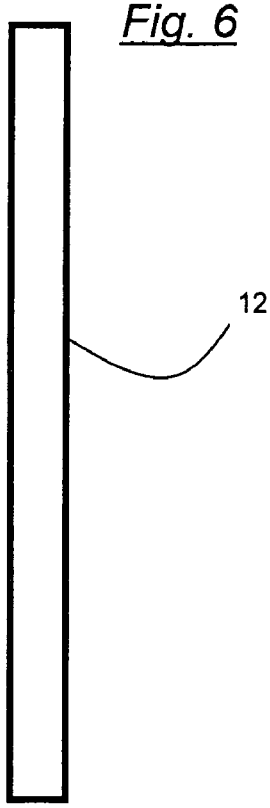
Figure 7:
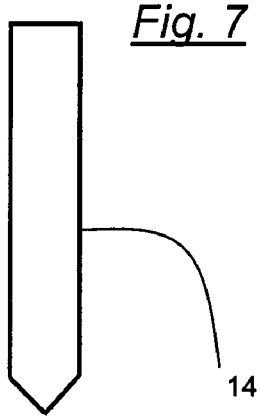
FIG. 7 is a perspective view of the post that supports the stand and target.
Figure 8:
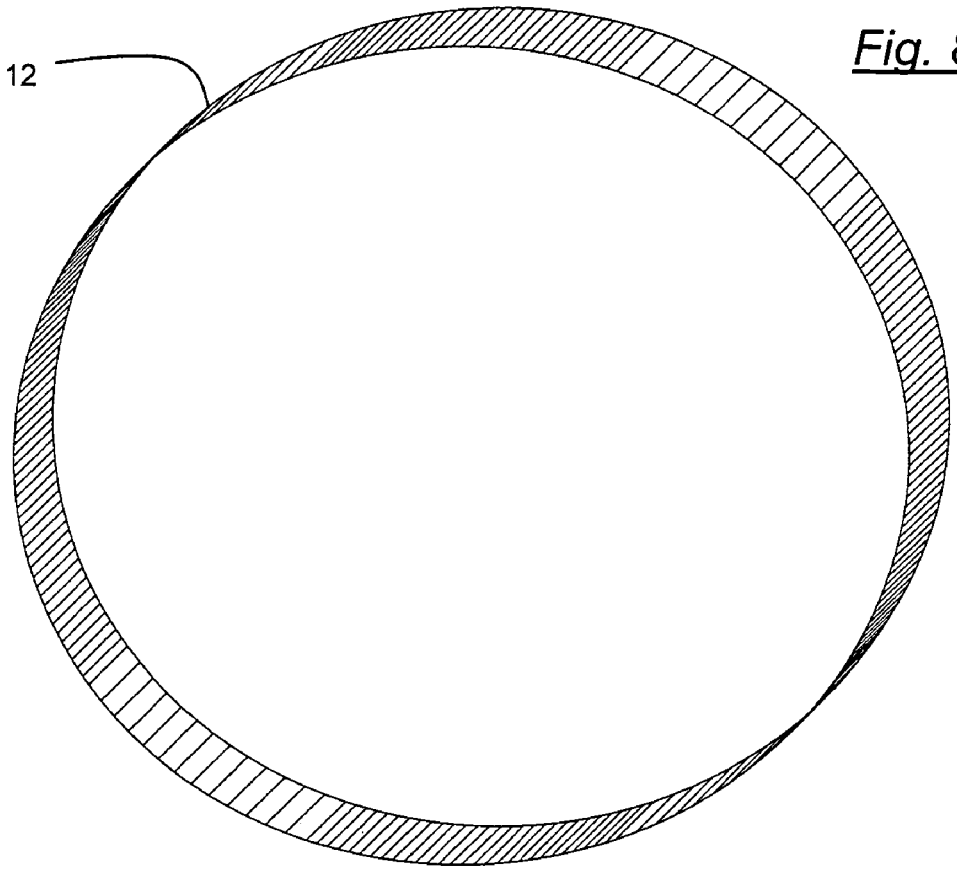
FIG. 8 is a partial top view of the stand and shows the three-dimensional aspect of its design.

10 three-dimensional reactionary turkey target
12 target stand
14 support post
16*a* pre-drilled hole for target
16*b* pre-drilled support post hole
16*c* pre-drilled hole for target
16*d* pre-drilled hole for target
16*e* pre-drilled support post hole
16*f* pre-drilled hole for target
18 head and neck target
20 connecting dowel
22 alternative embodiment of target stand
24 pre-drilled hole for target
26 pre-drilled support post hole

DETAILED DESCRIPTION OF THE INVENTION

In accordance with the preferred embodiment of the invention shown in FIGS. 1 to 8, a three-dimensional reactionary turkey target is generally designated by the reference number 10. The target 10 has a stand 12 that resembles that physical shape of a turkey. The stand 12 is constructed of polystyrene and is circular in shape. Preferably the width and density of the polystyrene used to construct the stand 12 is sufficient to absorb multiple impacts by pellets fired from a shotgun and to allow for multiple holes 16*a-f* to be drilled into the stand 12. The stand 12 is supported in an upright position by a single support post 14 that can be anchored into the ground in a conventional manner.

The stand 12 has two holes 16*b* and 16*e* drilled to facilitate the support post 14. Holes 16*a*, 16*c*, 16*d*, and 16*f* are drilled to provide for multiple placements of the head and neck target 18. The head and neck target 18 is connected to the stand 12 by means of a connecting dowel 20, which fits into holes 16*a*, 16*c*, 16*d*, and 16*f*.

A removable head and neck target 18 is composed of Plaster of Paris or other sturdy yet reactionary material, formed into a three-dimensional shape with the life-like appearance of a turkey.

The circular shape of the stand 12, the location of the pre-drilled holes 16*a*, 16*c*, 16*d*, and 16*f*, and the placement of holes 16*b* and 16*e* for support post 14 facilitate the simple and economical movement of the head and neck target 18 from left to right, top to bottom, or vice versa. Further, if the stand 12 is substantially damaged by shot it can easily be rotated to extend the life of said stand 12 while allowing for the head and neck target 18 to be attached to the stand 12 in undamaged locations.

To assemble the three-dimensional reactionary turkey target 10 the user inserts the support post 14 into the ground or other stationary object.

While practicing with the three-dimensional reactionary turkey target 10, the shooter can take any position relative to the target. The hunter can shoot from above, below, in front of, or behind the target, as well as from the usual broadside position. A successful hit will cause the reactionary head and neck target 18 to disintegrate, shatter, or break into large chunks.

Figure 9:
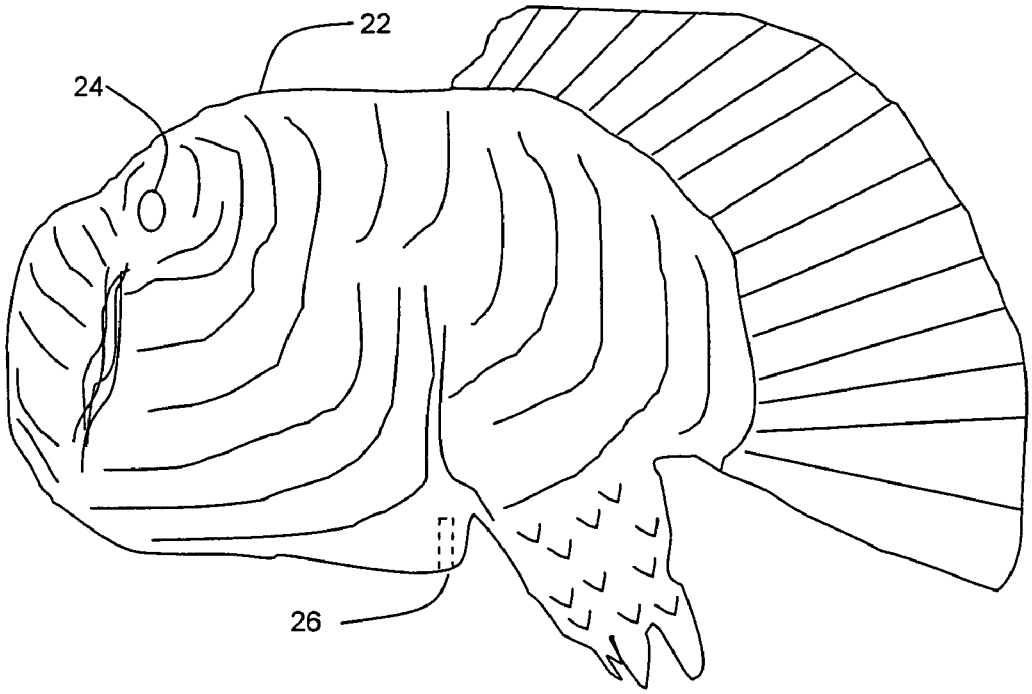
FIG. 9 is a perspective view of the target stand, shaped to simulate a turkey body, according to an alternative embodiment of the invention.

Another exemplary embodiment of the present invention is shown in FIG. 9, wherein the target stand 22 is shaped to more accurately represent the body of a male turkey. The tail fan, lowered wings, broad chest, beard, and rounded body are typical to the anatomy of a strutting male turkey. As with the preferred embodiment target stand 12, a hole 24 is provided in the target stand 22, by which means the head and neck target 18 connects to the target stand 22. Further, the target stand 22 shall have a hole 26 for the support post 14, which shall provide the means of support to hold the head and neck target 18 and the target stand 22 in an upright position.

Accordingly, the reader will see that the three-dimensional reactionary turkey target of this invention can be used to confirm the effectiveness of a turkey gun's shooting pattern, assess a shooter's accuracy, determine the efficacy of ammunition, and practice with a life-like target. Furthermore, the preferred embodiment of the target stand has the additional advantages in that

- a circular shape offers a reasonable facsimile of a strutting turkey;
- polystyrene is inexpensive to manufacture into circular shapes;
- polystyrene has the durability to withstand multiple indirect hits from shotgun pellets; and
- the circular shape allows the target stand to be rotated in the event said target stand is damaged by a misplaced shot.

In the drawings and specifications there has been set forth a preferred embodiment invention, and although specific terms are employed, those are used in a generic and descriptive sense only and are not for purposes of limitation. For example, the stand may have various shapes, such as the full three-dimensional form of a turkey body, oval, square, etc.; the stand may consist of various substances such as cloth, burlap, minicell, high-density foam, etc.; the head and neck target may be two-dimensional, hollowed-out, etc.; the head and neck target may be composed of Plaster of Paris, clay and pitch, biodegradable materials, etc.; the head and neck target may connect to the stand in ways other than described or be built as part of the general target structure, etc.; the support post may be molded into the stand itself or take on a different form than described, etc.

Thus, the scope of the invention should be determined by the appended claims and their legal equivalents, rather than by the examples given. Changes in the form, preparation, and relative location of parts as well as in the substitution of equivalents are contemplated as circumstances may suggest or render expedient without departing from the scope of the invention as defined in the following claims:

I claim:

1. A target for practicing turkey hunting or for measuring the accuracy or pattern of a shotgun, comprising:

a) a target stand of sufficient size and shape to approximate the form of a turkey's body, said stand having a perimeter surface with a plurality of holes formed therein, the holes spaced about the perimeter surface of said stand, said stand capable of being rotated to extend the life of said stand when a portion of said stand adjacent one of the holes is damaged by shot;

b) a frangible head and neck target of sufficient size and shape to approximate the three-dimensional form of a turkey's head and neck, said head and neck target capable of releasable connection to said target stand by cooperation with any one of the holes formed in said target stand;

c) means for releasably connecting said head and neck target to said target stand to allow the connected head and neck target and target stand to together substantially represent the comprehensive form of a turkey; and d) means for support at a base of said target stand and holding said connected head and neck target and target stand in a substantially upright position.

2. The target of claim 1 wherein said head and neck target approximates the colors of a turkey.

3. The target of claim 1 wherein the composition of said head and neck target is formed from Plaster of Paris.

4. The target of claim 1 wherein said target stand is circular in shape.

5. The target of claim 4 wherein said target stand is composed of polystyrene.

6. The target of claim 4 wherein said plurality of holes are drilled to accommodate said head and neck target and said means for support.

7. The target of claim 1 wherein said means for support at the base of said target stand is a length of metal, sharpened to a point on one end, and disposed in one of the holes.

8. The target of claim 1 wherein means for releasably connecting said head and neck target to said target stand is a connecting dowel.

9. The target of claim 1 wherein the damaged or destroyed head and neck target is easily removed and replaced.

10. The target of claim 8 wherein said connecting dowel is formed from wood.

11. The target of claim 1 wherein said means for releasably connecting said head and neck target to said target stand includes a connecting dowel, and said means for support at the base of said target stand includes a support post, each of the connecting dowel and the support post fitting into any of the holes.

12. The target of claim 1 wherein said target stand includes a first planar surface and a second planar surface, the first planar surface disposed parallel to the second planar surface, the first planar surface spaced apart from the second planar surface, the first planar surface and the second planar surface connected by the perimeter surface of said target stand.

13. The target of claim 12 wherein the plurality of holes formed in the perimeter surface includes at least two of a first hole, a second hole, a third hole, a fourth hole, a fifth hole, and a sixth hole.

14. The target of claim 13 wherein said target stand is circular in shape, and the first hole is formed in the perimeter surface at about a 225 degree angular position, the second hole is formed in the perimeter surface at about a 180 degree angular position at the base of said target stand, the third hole is formed in the perimeter surface at about a 135 degree angular position, the fourth hole is formed in the perimeter surface at about a 45 degree angular position, the fifth hole is formed in the perimeter surface at about a 0 degree angular position, and the sixth hole is formed in the perimeter surface at about a 315 degree angular position, wherein all angular positions are measured relative to a center point of one of the first planar surface and the second planar surface of said target stand.

15. The target of claim 12 wherein said target stand has one of a turkey body profile shape, an oval shape, and a square shape.

16. The target of claim 1 wherein said target stand represents a three-dimensional body of a male turkey.

17. The target of claim 16 wherein said target stand includes at least one of a tail fan, a pair of lowered wings, a broad chest, a beard, and a rounded body.

18. The target of claim 1 wherein said head and neck target is hollow.

19. A method of practicing turkey hunting or of measuring the accuracy or pattern of a shotgun, the method comprising the steps of:

a) providing a target for practicing turkey hunting or for measuring the accuracy or pattern of a shotgun, comprising i) a target stand of sufficient size and shape to approximate the form of a turkey's body, said stand having a perimeter surface with a plurality of holes formed therein, the holes spaced about the perimeter surface of said stand, said stand capable of being rotated to extend the life of said stand when a portion of said stand adjacent one of the holes is damaged by shot, ii) a frangible head and neck target of sufficient size and shape to approximate the three-dimensional form of a turkey's head and neck, said head and neck target capable of releasable connection to said target stand by cooperation with any one of the holes formed in said target stand, iii) means for releasably connecting said head and neck target to said target stand to allow the connected head and neck target and target stand to together substantially represent the comprehensive form of a turkey, and iv) means for support at a base of said target stand and holding said connected head and neck target and target stand in a substantially upright position;

b) connecting said frangible head and neck target to said stand for said frangible head and neck target;

c) firing the shotgun at said frangible head and neck target from any angle; and d) scoring a successful hit whenever the shot causes said frangible head and neck target to one of break, shatter, and be damaged, whereby a shooter can at least one of assess the pattern of the shotgun, gauge the shooter's accuracy, determine the efficacy of ammunition, and practice with the target.

* * * * *